US010094319B2

(12) United States Patent
Ulrey et al.

(10) Patent No.: US 10,094,319 B2
(45) Date of Patent: Oct. 9, 2018

(54) OPTIMIZING INTERMITTENT FUEL PUMP CONTROL

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 407 days.

(21) Appl. No.: 14/558,363

(22) Filed: Dec. 2, 2014

(65) Prior Publication Data

US 2016/0153383 A1 Jun. 2, 2016

(51) Int. Cl.

| | |
|---|---|
| ***F02D 41/30*** | (2006.01) |
| ***F02D 41/38*** | (2006.01) |
| ***F02D 41/24*** | (2006.01) |
| ***F02D 33/00*** | (2006.01) |
| *F02M 59/36* | (2006.01) |
| *F02M 37/00* | (2006.01) |
| *F02M 26/05* | (2016.01) |

(52) U.S. Cl.

CPC ..... *F02D 41/3082* (2013.01); *F02D 33/003* (2013.01); *F02D 41/2464* (2013.01); *F02D 41/3854* (2013.01); *F02D 2200/0602* (2013.01); *F02D 2200/0606* (2013.01); *F02M 26/05* (2016.02); *F02M 37/0058* (2013.01); *F02M 59/366* (2013.01)

(58) Field of Classification Search

CPC ..... F02D 41/3082; F02D 41/2464; F02D 41/3854; F02D 27/004; F02M 37/106; F04B 49/06; F04B 49/08; F04B 2207/042; F04B 2207/0421; F04B 2207/0422; F04B 2207/0423; F04B 2205/04; F04B 2205/05; F04B 2205/13; F04B 2203/0213

USPC ..... 123/458

See application file for complete search history.

(56) References Cited

U.S. PATENT DOCUMENTS

| | | | |
|---|---|---|---|
| 3,822,677 | A | 7/1974 | Reddy |
| 3,967,598 | A | 7/1976 | Rachel |

(Continued)

FOREIGN PATENT DOCUMENTS

| | | | |
|---|---|---|---|
| EP | 2434137 | B1 | 7/2013 |
| WO | 2014031400 | A1 | 2/2014 |

OTHER PUBLICATIONS

Pursifull, Ross D., "System and Method for Operating an Engine Combusting Liquefied Petroleum Gas," U.S. Appl. No. 13/970,519, filed Aug. 19, 2013, 30 pages.

(Continued)

*Primary Examiner* — Hai Huynh
*Assistant Examiner* — Gonzalo Laguarda
(74) *Attorney, Agent, or Firm* — Julia Voutyras; McCoy Russell LLP

(57) ABSTRACT

Various methods are provided for operating a fuel pump. In one example, a method of operating a fuel pump comprises iteratively reducing an on-duration of a low pressure fuel pump pulse, until a peak outlet pressure of the fuel pump decreases from a peak outlet pressure corresponding to a previous pulse, to identify a minimum pulse duration, and applying a pulse having the minimum pulse duration to the fuel pump.

20 Claims, 6 Drawing Sheets

(56) References Cited

U.S. PATENT DOCUMENTS

| | | | | |
|---|---|---|---|---|
| 4,200,063 | A * | 4/1980 | Bowler | F02D 41/0087 123/478 |
| 4,307,450 | A * | 12/1981 | Carp | F02D 41/266 123/696 |
| 4,926,829 | A * | 5/1990 | Tuckey | F02D 33/003 123/41.31 |
| 5,477,833 | A | 12/1995 | Leighton | |
| 5,542,395 | A * | 8/1996 | Tuckey | F02D 41/3082 123/381 |
| 5,579,739 | A * | 12/1996 | Tuckey | F02D 33/003 123/463 |
| 5,878,727 | A | 3/1999 | Huls | |
| 5,884,610 | A | 3/1999 | Reddy | |
| 5,937,826 | A | 8/1999 | Olson et al. | |
| 6,024,064 | A | 2/2000 | Kato et al. | |
| 6,138,638 | A | 10/2000 | Morikawa | |
| 6,142,747 | A | 11/2000 | Rosenau et al. | |
| 6,196,203 | B1 | 3/2001 | Grieve et al. | |
| 6,453,878 | B1 * | 9/2002 | Mazet | F02D 41/3082 123/497 |
| 6,694,950 | B2 | 2/2004 | Djordjevic | |
| 6,854,321 | B2 | 2/2005 | Amlin | |
| 6,964,262 | B2 | 11/2005 | Hayakawa | |
| 6,988,488 | B2 | 1/2006 | Pursifull et al. | |
| 7,025,050 | B2 | 4/2006 | Oono et al. | |
| 7,059,313 | B2 | 6/2006 | Lippa | |
| 7,128,057 | B2 | 10/2006 | Wiese et al. | |
| 7,272,485 | B2 | 9/2007 | Amano et al. | |
| 7,640,916 | B2 | 1/2010 | Ulrey et al. | |
| 7,759,010 | B2 | 7/2010 | Hoch | |
| 7,832,375 | B2 | 11/2010 | Dusa et al. | |
| 7,886,720 | B2 | 2/2011 | Graf | |
| 8,061,329 | B2 | 11/2011 | Pursifull et al. | |
| 8,483,932 | B2 | 7/2013 | Pursifull | |
| 8,776,764 | B2 | 7/2014 | Basmaji et al. | |
| 2001/0029925 | A1 | 10/2001 | Ferry et al. | |
| 2002/0170539 | A1 | 11/2002 | Rembold et al. | |
| 2005/0257779 | A1 | 11/2005 | Knight et al. | |
| 2009/0090331 | A1 | 4/2009 | Pursifull | |
| 2010/0108035 | A1 * | 5/2010 | Dusa | F02D 41/06 123/453 |
| 2010/0332108 | A1 | 12/2010 | Kato et al. | |
| 2011/0106393 | A1 | 5/2011 | Pursifull | |
| 2011/0209687 | A1 | 9/2011 | Schroeder et al. | |
| 2013/0061830 | A1 | 3/2013 | Hornby et al. | |
| 2013/0138325 | A1 | 5/2013 | Lee | |
| 2014/0109875 | A1 | 4/2014 | Lachaize | |
| 2014/0120440 | A1 | 5/2014 | Nolan et al. | |
| 2014/0224217 | A1 | 8/2014 | Pursifull et al. | |
| 2014/0227107 | A1 * | 8/2014 | Bauer | F04B 43/04 417/44.2 |
| 2014/0230794 | A1 | 8/2014 | Surnilla et al. | |
| 2014/0297071 | A1 | 10/2014 | Dudar et al. | |
| 2015/0027416 | A1 | 1/2015 | Brostrom et al. | |

OTHER PUBLICATIONS

Pursifull, Ross D. et al., "High Pressure Fuel Pump Control for Idle Tick Reduction," U.S. Appl. No. 14/042,971, filed Oct. 1, 2013, 34 pages.

Surnilla, Gopichandra et al., "Adaptive Learning of Duty Cycle for a High Pressure Fuel Pump," U.S. Appl. No. 14/099,615, filed Dec. 6, 2013, 44 pages.

Surnilla, Gopichandra et al., "Robust Direct Injection Fuel Pump System," U.S. Appl. No. 14/155,250, filed Jan. 14, 2014, 61 pages.

Pursifull, Ross D. et al., "Method and System for Characterizing a Port Fuel Injector," U.S. Appl. No. 14/192,768, filed Feb. 27, 2014, 44 pages.

Surnilla, Gopichandra et al., "High Pressure Fuel Pumps with Mechanical Pressure Regulation," U.S. Appl. No. 14/243,615, filed Apr. 2, 2014, 53 pages.

Ulrey, Joseph N. et al., "Adjusting Pump Volume Commands for Direct Injection Fuel Pumps," U.S. Appl. No. 14/300,162, filed Jun. 9, 2014, 42 pages.

Ulrey, Joseph N. et al., "Current Pulsing Control Methods for Lift Fuel Pumps," U.S. Appl. No. 14/444,739, filed Jul. 28, 2014, 48 pages.

Pursifull, Ross D., "Method and System for Supplying Liquefied Petroleum Gas to a Direct Fuel Injected Engine," U.S. Appl. No. 14/532,756, filed Nov. 4, 2014, 39 pages.

Pursifull, Ross D., "Method and System for Fuel System Control," U.S. Appl. No. 14/551,906, filed Nov. 24, 2014, 46 pages.

Sanborn, Ethan D. et al., "Identifying Fuel System Degradation," U.S. Appl. No. 14/558,295, filed Dec. 2, 2014, 53 pages.

Ulrey, Joseph N. et al., "Systems and Methods for Sensing Fuel Vapor Pressure," U.S. Appl. No. 14/558,406, filed Dec. 2, 2014, 43 pages.

Pursifull, Ross D., "Method for Lift Pump Control," U.S. Appl. No. 14/558,482, filed Dec. 2, 2014, 53 pages.

Pursifull, Ross D., "Direct Injection Pump Control," U.S. Appl. No. 14/560,497, filed Dec. 4, 2014, 49 pages.

Surnilla, Gopichandra et al., "Methods and Systems for Fixed and Variable Pressure Fuel Injection," U.S. Appl. No. 14/570,546, filed Dec. 15, 2014, 51 pages.

* cited by examiner

OPTIMIZING INTERMITTENT FUEL PUMP CONTROL

FIELD

The field of the disclosure relates operating a fuel pump.

BACKGROUND AND SUMMARY

Lift pump control systems may be used for a variety of purposes including vapor management, injection pressure control, temperature control, and lubrication. In one example, a lift pump supplies fuel to a higher pressure fuel pump that provides a high injection pressure for direct injectors in an internal combustion engine. The higher pressure fuel pump may provide the high injection pressure by supplying high pressure fuel to a fuel rail to which the direct injectors are coupled. A fuel pressure sensor may be disposed in the fuel rail to enable measurement of the fuel rail pressure, on which various aspects of engine operation may be based, such as fuel injection.

U.S. Pat. No. 7,640,916 discloses systems and methods for operating a fuel system in which a lift pump is intermittently, and not continuously, driven. Intermittent driving of the lift pump allows the energy expended in operating the lift pump to be reduced while maintaining the supply of adequate fuel pressures to a higher pressure fuel pump downstream of the lift pump. In some examples, driving of the lift pump may be initiated to maintain the pressure at the inlet of the higher pressure fuel pump above fuel vapor pressure, thereby maintaining the efficiency of the higher pressure fuel pump at a desired level. Conversely, driving of the lift pump may be ceased once the inlet pressure of the higher pressure fuel pump exceeds a predetermined threshold.

The inventors herein have recognized an issue with the approach identified above. Because the times at which initiation and cessation of lift pump actuation may be based on the required inlet pressure of the higher pressure fuel pump, the duration in which the lift pump is actuated may be excessive, unnecessarily increasing energy consumption. For example, the fuel volume pumped as a result of actuating the lift pump for a duration determined in this manner may be greater than a fuel volume required for operating an engine.

One approach that at least partially addresses the above issues includes a method of operating a fuel pump comprising iteratively reducing an on-duration of a low pressure fuel pump pulse, until a peak outlet pressure of the fuel pump decreases from a peak outlet pressure corresponding to a previous pulse, to identify a minimum pulse duration, and applying a pulse having the minimum pulse duration to the fuel pump.

In a more specific example, applying the pulse having the minimum pulse duration to the fuel pump causes the fuel pump to pump a desired fuel volume.

In another example, the on-duration of the fuel pump pulse is iteratively reduced until a duration for which the fuel pump outputs the peak outlet pressure falls below a threshold.

In this way, energy consumption of a fuel pump may be minimized while enabling the fuel pump to supply sufficient fuel volumes to an engine. Thus, the technical result is achieved by these actions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Finally, the above explanation does not admit any of the information or problems were well known.

DETAILED DESCRIPTION

Figure 1:
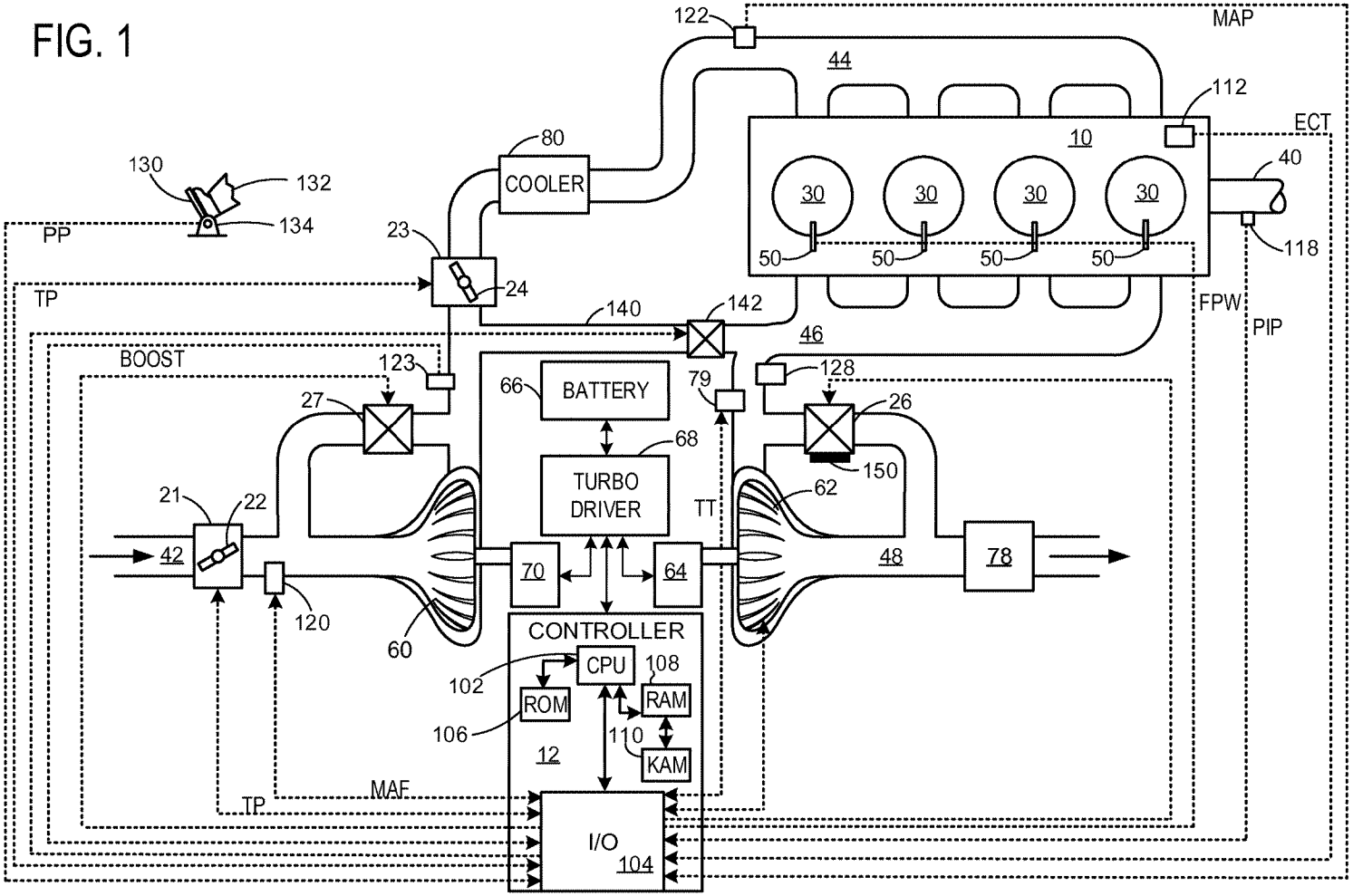
FIG. 1 is a schematic diagram showing an example engine.
Figure 2:
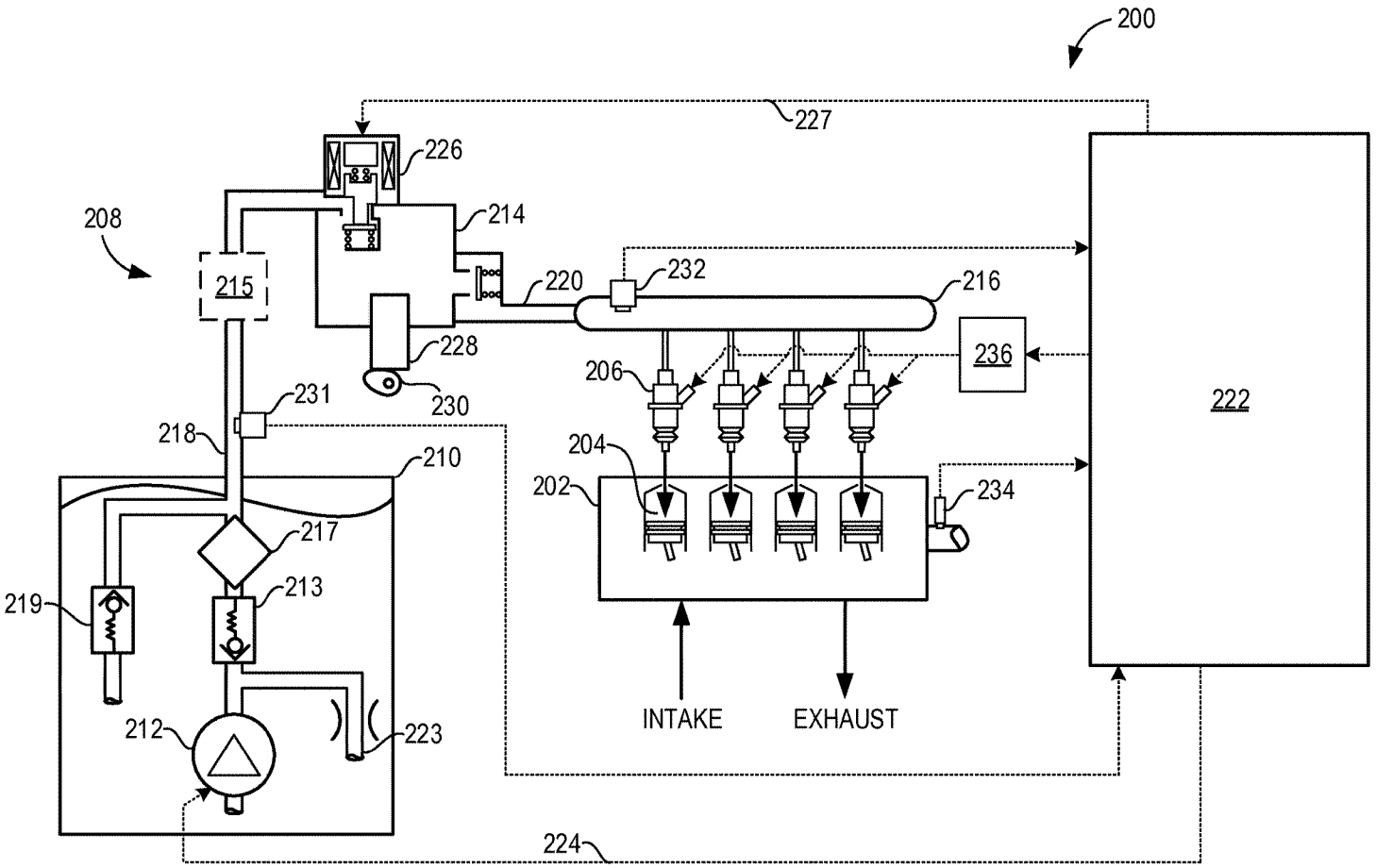
FIG. 2 shows a direct injection engine system.
Figure 3:
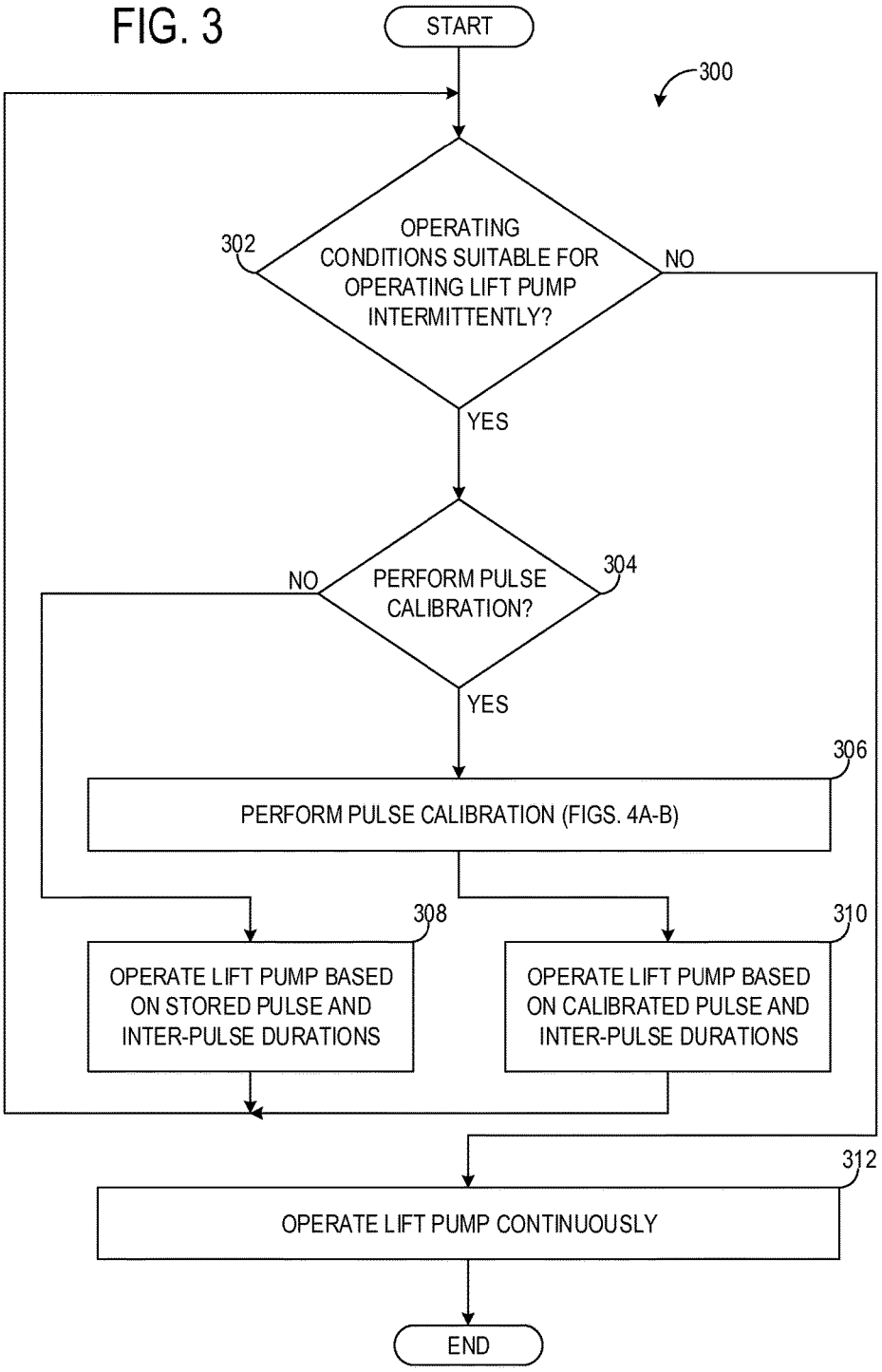
FIG. 3 shows a flowchart illustrating a method of operating a lift pump.
Figure 4A:
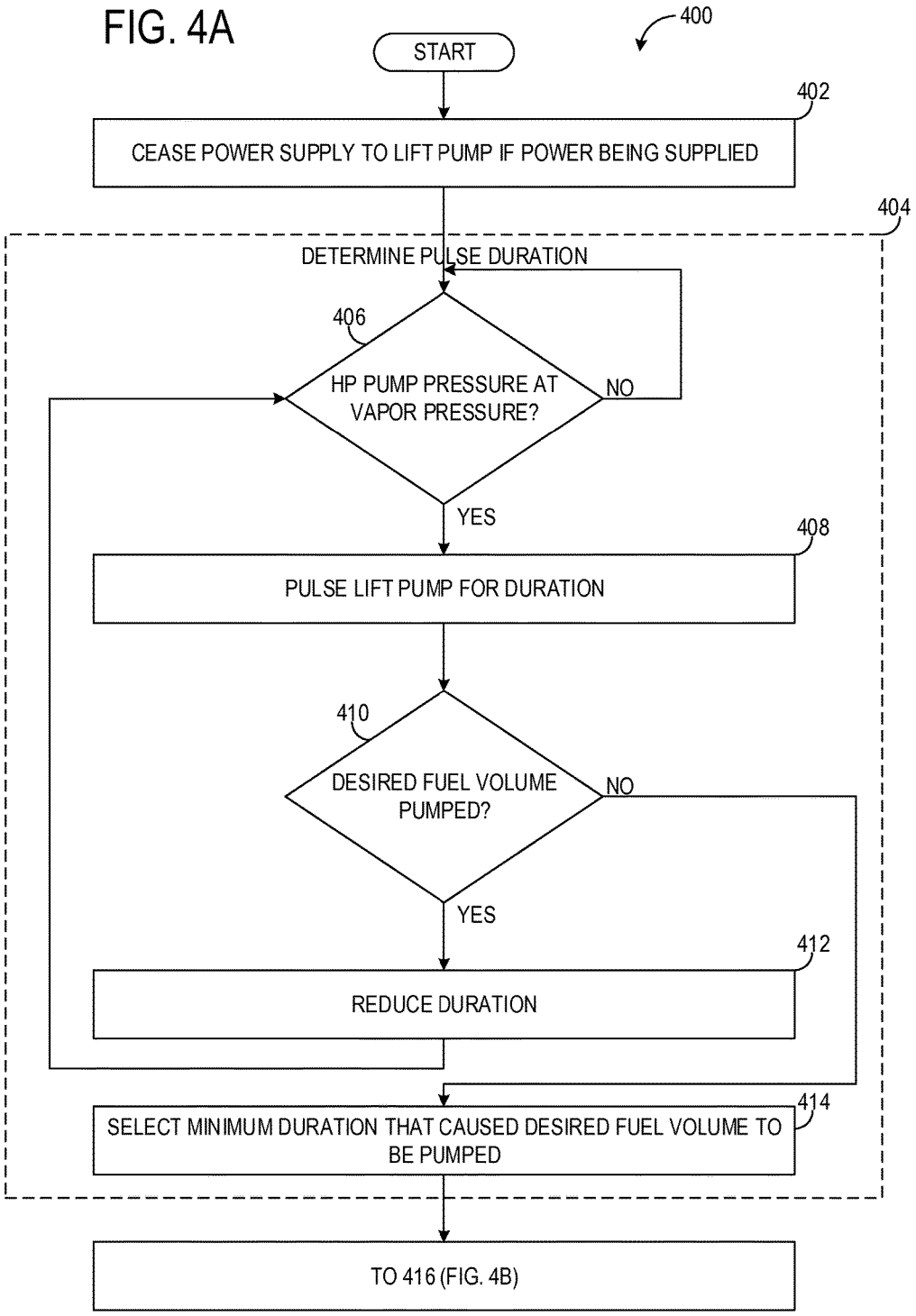
FIGS. 4A and 4B show a flowchart illustrating a method of performing pulse calibration.
Figure 4B:
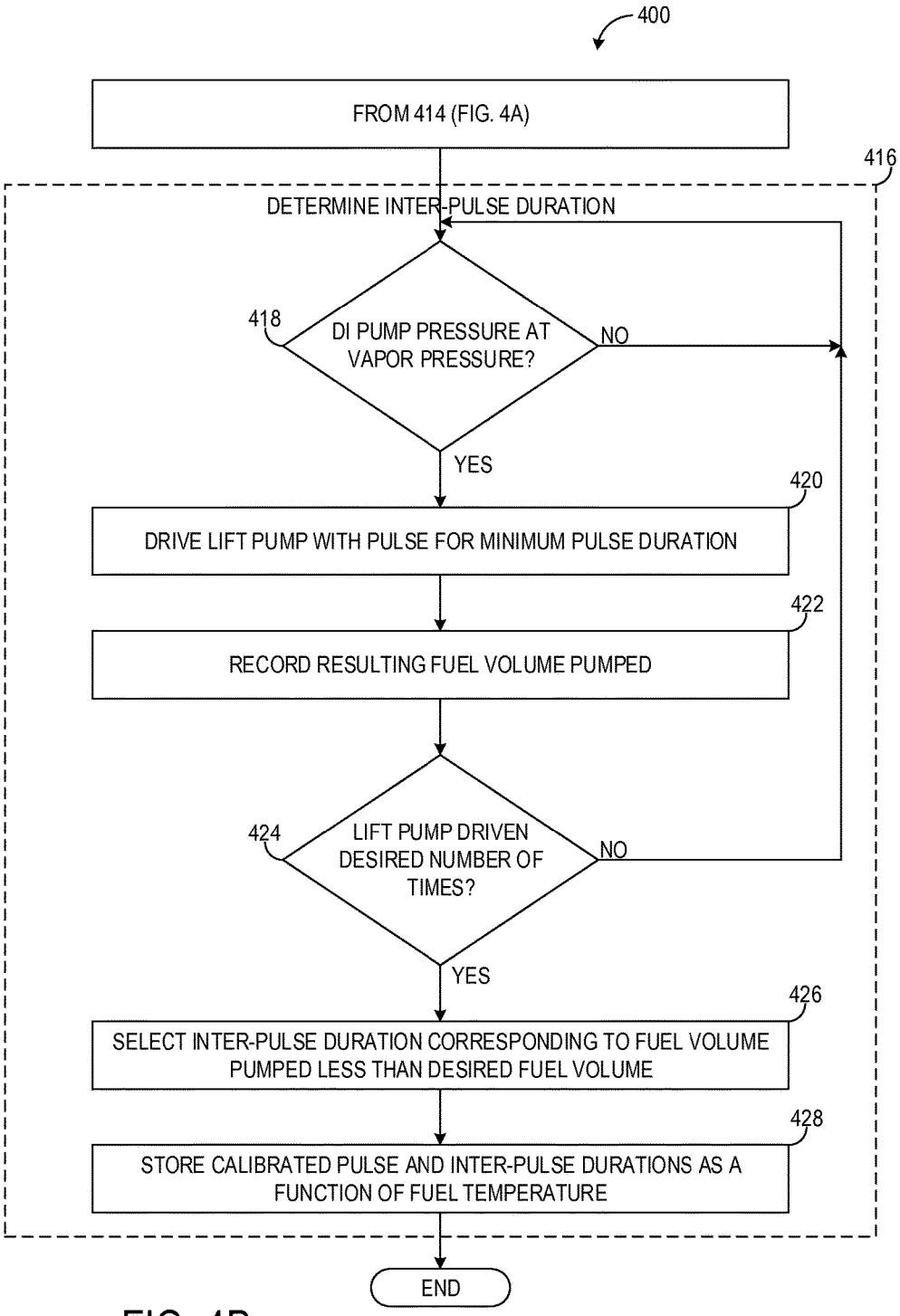
Figure 5:
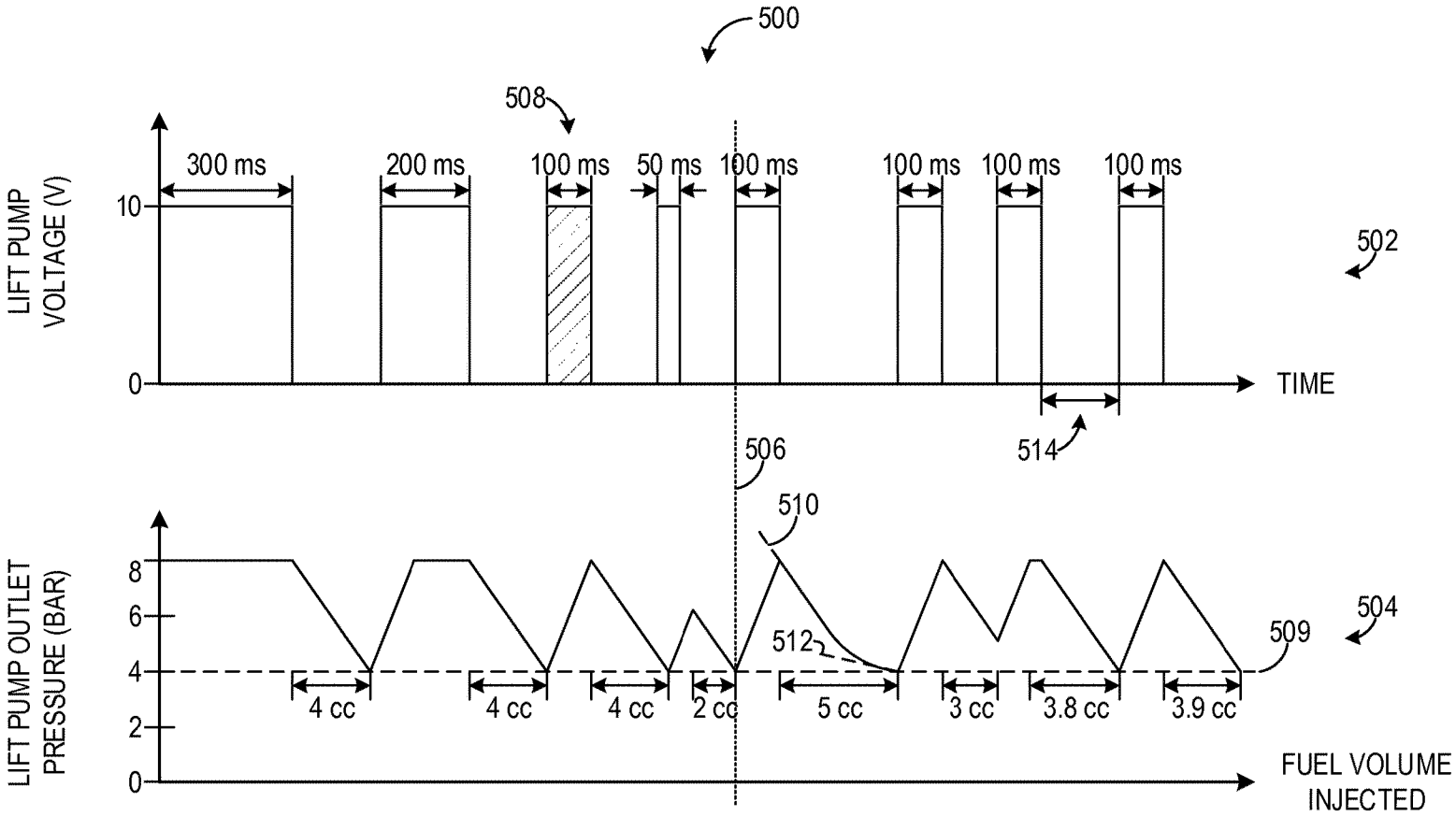
FIG. 5 shows a graph illustrating pulse calibration for a lift fuel pump.

Various methods are provided for operating a fuel pump. In one example, a method of operating a fuel pump comprises iteratively reducing an on-duration of a low pressure fuel pump pulse, until a peak outlet pressure of the fuel pump decreases from a peak outlet pressure corresponding to a previous pulse, to identify a minimum pulse duration, and applying a pulse having the minimum pulse duration to the fuel pump. FIG. 1 is a schematic diagram showing an example engine, FIG. 2 shows a direct injection engine system, FIG. 3 shows a flowchart illustrating a method of operating a lift pump, FIGS. 4A and 4B show a flowchart illustrating a method of performing pulse calibration, and FIG. 5 shows a graph illustrating pulse calibration for a lift fuel pump. The engines of FIGS. 1 and 2 also include a controller configured to carry out the methods depicted in FIGS. 3-4B.

FIG. 1 is a schematic diagram showing an example engine 10, which may be included in a propulsion system of an automobile. The engine 10 is shown with four cylinders 30. However, other numbers of cylinders may be used in accordance with the current disclosure. Engine 10 may be controlled at least partially by a control system including controller 12, and by input from a vehicle operator 132 via an input device 130. In this example, input device 130 includes an accelerator pedal and a pedal position sensor 134 for generating a proportional pedal position signal PP. Each combustion chamber (e.g., cylinder) 30 of engine 10 may include combustion chamber walls with a piston (not shown) positioned therein. The pistons may be coupled to a crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel to enable a starting operation of engine 10.

Combustion chambers 30 may receive intake air from intake manifold 44 via intake passage 42 and may exhaust combustion gasses via exhaust passage 48. Intake manifold 44 and exhaust manifold 46 can selectively communicate with combustion chamber 30 via respective intake valves and exhaust valves (not shown). In some embodiments, combustion chamber 30 may include two or more intake valves and/or two or more exhaust valves.

Fuel injectors 50 are shown coupled directly to combustion chamber 30 for injecting fuel directly therein in proportion to the pulse width of signal FPW received from controller 12. In this manner, fuel injector 50 provides what is known as direct injection of fuel into combustion chamber 30. The fuel injector may be mounted in the side of the combustion chamber or in the top of the combustion chamber, for example. Fuel may be delivered to fuel injector 50 by a fuel system (not shown) including a fuel tank, a fuel pump, and a fuel rail. An example fuel system that may be employed in conjunction with engine 10 is described below with reference to FIG. 2. In some embodiments, combustion chambers 30 may alternatively, or additionally, include a fuel injector arranged in intake manifold 44 in a configuration that provides what is known as port injection of fuel into the intake port upstream from each combustion chamber 30.

Intake passage 42 may include throttle 21 and 23 having throttle plates 22 and 24, respectively. In this particular example, the position of throttle plates 22 and 24 may be varied by controller 12 via signals provided to an actuator included with throttles 21 and 23. In one example, the actuators may be electric actuators (e.g., electric motors), a configuration that is commonly referred to as electronic throttle control (ETC). In this manner, throttles 21 and 23 may be operated to vary the intake air provided to combustion chamber 30 among other engine cylinders. The position of throttle plates 22 and 24 may be provided to controller 12 by throttle position signal TP. Intake passage 42 may further include a mass air flow sensor 120, a manifold air pressure sensor 122, and a throttle inlet pressure sensor 123 for providing respective signals MAF (mass airflow) MAP (manifold air pressure) to controller 12.

Exhaust passage 48 may receive exhaust gasses from cylinders 30. Exhaust gas sensor 128 is shown coupled to exhaust passage 48 upstream of turbine 62 and emission control device 78. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO, a NOx, HC, or CO sensor, for example. Emission control device 78 may be a three way catalyst (TWC), NOx trap, various other emission control devices, or combinations thereof.

Exhaust temperature may be measured by one or more temperature sensors (not shown) located in exhaust passage 48. Alternatively, exhaust temperature may be inferred based on engine operating conditions such as speed, load, AFR, spark retard, etc.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112, shown schematically in one location within the engine 10; a profile ignition pickup signal (PIP) from Hall effect sensor 118 (or other type) coupled to crankshaft 40; the throttle position (TP) from a throttle position sensor, as discussed; and absolute manifold pressure signal, MAP, from sensor 122, as discussed. Engine speed signal, RPM, may be generated by controller 12 from signal PIP. Manifold pressure signal MAP from a manifold pressure sensor may be used to provide an indication of vacuum, or pressure, in the intake manifold 44. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft 40. In some examples, storage medium read-only memory 106 may be programmed with computer readable data representing instructions executable by processor 102 for performing the methods described below as well as other variants that are anticipated but not specifically listed.

Engine 10 may further include a compression device such as a turbocharger or supercharger including at least a compressor 60 arranged along intake manifold 44. For a turbocharger, compressor 60 may be at least partially driven by a turbine 62, via, for example a shaft, or other coupling arrangement. The turbine 62 may be arranged along exhaust passage 48 and communicate with exhaust gasses flowing therethrough. Various arrangements may be provided to drive the compressor. For a supercharger, compressor 60 may be at least partially driven by the engine and/or an electric machine, and may not include a turbine. Thus, the amount of compression provided to one or more cylinders of the engine via a turbocharger or supercharger may be varied by controller 12. In some cases, the turbine 62 may drive, for example, an electric generator 64, to provide power to a battery 66 via a turbo driver 68. Power from the battery 66 may then be used to drive the compressor 60 via a motor 70. Further, a sensor 123 may be disposed in intake manifold 44 for providing a BOOST signal to controller 12.

Further, exhaust passage 48 may include wastegate 26 for diverting exhaust gas away from turbine 62. In some embodiments, wastegate 26 may be a multi-staged wastegate, such as a two-staged wastegate with a first stage configured to control boost pressure and a second stage configured to increase heat flux to emission control device 78. Wastegate 26 may be operated with an actuator 150, which may be an electric actuator such as an electric motor, for example, though pneumatic actuators are also contemplated. Intake passage 42 may include a compressor bypass valve 27 configured to divert intake air around compressor 60. Wastegate 26 and/or compressor bypass valve 27 may be controlled by controller 12 via actuators (e.g., actuator 150) to be opened when a lower boost pressure is desired, for example.

Intake passage 42 may further include charge air cooler (CAC) 80 (e.g., an intercooler) to decrease the temperature of the turbocharged or supercharged intake gasses. In some embodiments, charge air cooler 80 may be an air to air heat exchanger. In other embodiments, charge air cooler 80 may be an air to liquid heat exchanger.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor (not shown) may be arranged within the EGR passage and may provide an indication of one or more of pressure, temperature, and concentration of the exhaust gas. Alternatively, the EGR may be controlled through a calculated value based on signals from the MAF sensor (upstream), MAP (intake manifold), MAT (manifold gas temperature) and the crank speed sensor. Further, the EGR may be controlled based on an exhaust $O_2$ sensor and/or an intake oxygen sensor (intake manifold). Under some conditions, the EGR system may be used to regulate the temperature of the air and fuel mixture within the combustion chamber. FIG. 1 shows a high pressure EGR system where EGR is routed from upstream of a turbine of a turbocharger to downstream of a compressor of a turbocharger. In other embodiments, the engine may additionally or alternatively include a low pressure EGR system where EGR is routed from downstream of a turbine of a turbocharger to upstream of a compressor of the turbocharger.

FIG. 2 shows a direct injection engine system 200, which may be configured as a propulsion system for a vehicle. The engine system 200 includes an internal combustion engine 202 having multiple combustion chambers or cylinders 204. Engine 202 may be engine 10 of FIG. 1, for example. Fuel can be provided directly to the cylinders 204 via in-cylinder direct injectors 206. As indicated schematically in FIG. 2, the engine 202 can receive intake air and exhaust products of the combusted fuel. The engine 202 may include a suitable type of engine including a gasoline or diesel engine.

Fuel can be provided to the engine 202 via the injectors 206 by way of a fuel system indicated generally at 208. In this particular example, the fuel system 208 includes a fuel storage tank 210 for storing the fuel on-board the vehicle, a lower pressure fuel pump 212 (e.g., a fuel lift pump), a higher pressure fuel pump 214, an accumulator 215, a fuel rail 216, and various fuel passages 218 and 220. In the example shown in FIG. 2, the fuel passage 218 carries fuel from the lower pressure pump 212 to the higher pressure fuel pump 214, and the fuel passage 220 carries fuel from the higher pressure fuel pump 214 to the fuel rail 216.

The lower pressure fuel pump 212 can be operated by a controller 222 (e.g., controller 12 of FIG. 1) to provide fuel to higher pressure fuel pump 214 via fuel passage 218. The lower pressure fuel pump 212 can be configured as what may be referred to as a fuel lift pump. As one example, lower pressure fuel pump 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller 222 reduces the electrical power that is provided to pump 212, the volumetric flow rate and/or pressure increase across the pump may be reduced. The volumetric flow rate and/or pressure increase across the pump may be increased by increasing the electrical power that is provided to the pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, as indicated at 224, the flow rate and pressure of the fuel provided to higher pressure fuel pump 214 and ultimately to fuel rail 216 may be adjusted by the controller 222. In addition to providing injection pressure for direct injectors 206, pump 212 may provide injection pressure for one or more port fuel injectors (not shown in FIG. 2) in some implementations. However, as depicted in FIG. 2 lift pump 212 supplies pressure to high pressure pump 214 which supplies a higher-yet injection pressure.

Low-pressure fuel pump 212 may be fluidly coupled to a filter 217, which may remove small impurities that may be contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential setpoint at which relief valve 219 may be configured to open may assume various suitable values; as a non-limiting example the setpoint may be 6.4 bar(g). In some embodiments, an orifice check valve (not shown in FIG. 2) may be placed in series with an orifice 223 to allow for air and/or fuel vapor to bleed out of the lift pump 212. In some embodiments, fuel system 208 may include one or more (e.g., a series) of check valves fluidly coupled to low-pressure fuel pump 212 to impede fuel from leaking back upstream of the valves. In this context, upstream flow refers to fuel flow traveling from fuel rail 216 toward low-pressure pump 212 while downstream flow refers to the nominal fuel flow direction from the low-pressure pump toward the fuel rail.

The higher pressure fuel pump 214 can be controlled by the controller 222 to provide fuel to the fuel rail 216 via the fuel passage 220. As one non-limiting example, higher pressure fuel pump 214 may be a BOSCH HDP5 HIGH PRESSURE PUMP, which utilizes a flow control valve (e.g., fuel volume regulator, magnetic solenoid valve, etc.) 226 to enable the control system to vary the effective pump volume of each pump stroke, as indicated at 227. However, it should be appreciated that other suitable higher pressure fuel pumps may be used. The higher pressure fuel pump 214 may be mechanically driven by the engine 202 in contrast to the motor driven lower pressure fuel pump 212. A pump piston 228 of the higher pressure fuel pump 214 can receive a mechanical input from the engine crank shaft or cam shaft via a cam 230. In this manner, higher pressure pump 214 can be operated according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222. In some examples, higher pressure fuel pump 214 may supply sufficiently high fuel pressure to injectors 206. As injectors 206 may be configured as direct fuel injectors, higher pressure fuel pump 214 may be referred to as a direct injection (DI) fuel pump.

FIG. 2 depicts the optional inclusion of accumulator 215, introduced above. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. The volume of accumulator 215 may be sized such that engine 202 can operate at idle conditions for a predetermined period of time between operating intervals of lower pressure fuel pump 212. Accumulator delta volumes are typically less than 10 cc, for example. For example, accumulator 215 can be sized such that when engine 202 idles, it takes one or more minutes to deplete pressure in the accumulator to a level at which higher pressure fuel pump 214 is incapable of maintaining a sufficiently high fuel pressure for fuel injectors 206. Accumulator 215 may thus enable an intermittent operation mode of lower pressure fuel pump 212 described below. In other embodiments, accumulator 215 may inherently exist in the compliance of fuel filter 217 and fuel line 218, and thus may not exist as a distinct element.

The controller 222 can individually actuate each of the injectors 206 via a fuel injection driver 236. The controller 222, the driver 236, and other suitable engine system controllers can comprise a control system. While the driver 236 is shown external to the controller 222, it should be appreciated that in other examples, the controller 222 can include the driver 236 or can be configured to provide the functionality of the driver 236. Controller 222 may include additional components not shown, such as those included in controller 12 of FIG. 1.

Fuel system 208 includes a low pressure (LP) fuel pressure sensor 231 positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump 214. LP fuel pressure sensor 231 may also be used to determine whether sufficient fuel pressure is provided to higher pressure fuel pump 214 so that the higher pressure fuel pump ingests liquid fuel and not fuel vapor, and/or to minimize the average electrical power supplied to lift pump 212. It will be understood that in other embodiments in which a port-fuel injection system, and not a direct injection system, is used, LP fuel pressure sensor 231 may sense both lift pump pressure and fuel injection. Further, while LP fuel pressure sensor 231 is shown as being positioned upstream of accumulator 215, in other embodiments the LP sensor may be positioned downstream of the accumulator.

As shown in FIG. 2, the fuel rail 216 includes a fuel rail pressure sensor 232 for providing an indication of fuel rail pressure to the controller 222. An engine speed sensor 234 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

As alluded to above, the inclusion of accumulator 215 in fuel system 208 may enable intermittent operation of lift pump 212, at least during selected conditions. Intermittently operating lift pump 212 may include turning the pump on and off, where during off periods the pump speed falls to zero, for example. Intermittent lift pump operation may be employed to maintain the respective efficiencies of lift pump 212 and higher pressure fuel pump 214 at respective desired levels while reducing the energy consumed by lift pump 212 yet still pumping desired fuel volumes to engine 202. Full volumetric efficiency of higher pressure fuel pump 214 is caused by sufficient fuel pressure at its inlet. The inlet pressure of higher pressure fuel pump 214 may be determined via LP fuel pressure sensor 231, or may be inferred based on various operating parameters. The efficiency of pump 214 may be computed based on the rate of fuel consumption by engine 202, the fuel pressure in fuel rail 216, the pump command, and the engine speed.

As described above, intermittent operation of lift pump 212 may include turning the lift pump on followed by turning the lift pump off. Turning lift pump 212 on and off may be performed on an iterative basis such that, in the intermittent operating mode, the lift pump is driven with successive voltage pulses spaced apart from one another. In some examples, the duration of the pulses may be determined online during engine operation. For example, a desired pulse duration may be determined online as part of a calibration routine described below and applied to all pulses until subsequent performance of the calibration routine. Similarly, a desired inter-pulse duration may be determined online as part of a calibration routine described below and applied between all pulses such that each pair of successive pulses is separated by the desired inter-pulse duration. Thus, in some scenarios all pulses may share the same pulse duration, with successive pulses being separated by the same inter-pulse duration for a given period of intermittent operation. Optimization of the pulse and inter-pulse durations may enable the potential advantages of the intermittent operating mode: minimization of the energy consumed by lift pump 212 while maintaining supply of desired fuel volumes to engine 202. Further energy savings may be obtained by optimizing the pulse and inter-pulse durations relative to other approaches in which a lift pump is operated intermittently but whose pulse and inter-pulse durations are not optimized.

In some examples, determination of the pulse and inter-pulse durations may be performed during selected operating conditions. For example, the selected operating conditions may stipulate that pulse calibration be performed only if one or both of the speed and load of engine 202 are below respective thresholds. "Pulse calibration" as used herein may refer to the determination of both pulse and inter-pulse durations. In some examples, pulse calibration may be performed only if one or both of the speed and load of engine 202 are relatively low. Such conditions may be employed so that changes in operation of lift pump 212 as part of pulse calibration do not disrupt operation of engine 202 and degrade vehicle drivability at operating regions where there is less tolerance for changes in fuel supply to the engine—e.g., relatively high engine speeds and/or loads. The selected operating conditions may alternatively or additionally stipulate that pulse calibration not be performed during idle operation of engine 202, as, during idle operation, noise, vibration, and harshness (NVH) resulting from performance of the calibration may perceptible by a vehicle operator and thus degrade vehicle drivability.

If the selected operating conditions are met, pulse calibration may begin by ceasing application of power to lift pump 212. In some examples, this may involve an exit from operating lift pump 212 according to a continuous operating mode described below. With lift pump 212 deactivated, the pressure at the inlet of higher pressure fuel pump 214 may be monitored (e.g., via LP fuel pressure sensor 231) until it is determined that this pressure has reached the fuel vapor pressure. The fuel vapor pressure is the minimum pressure in fuel system 208 due to the presence of fuel; the fuel vapor pressure may be reached when higher pressure fuel pump 214 begins to ingest vapor or when fuel injectors 206 inject fuel until a ullage space forms, for example. To achieve the fuel vapor pressure, lift pump 212 may be deactivated for a suitable duration while higher pressure fuel pump 214 consumes a particular volume of fuel (e.g., 4 cc). The volume of fuel may be determined based on the compliance of lower pressure fuel plumbing, the initial fuel pressure in fuel system 208, and the expected fuel vapor pressure, which may be determined according to fuel temperature, for example.

Once the pressure at the inlet of higher pressure fuel pump 214 has reached the fuel vapor pressure, lift pump 212 may be pulsed for an initial duration. Then, the resulting fuel volume that is pumped as a consequence of pulsing lift pump 212 for the initial duration may be determined and compared to a desired fuel volume. Selection of the initial duration is an initial attempt at identifying a minimum pulse duration whose application to lift pump 212 results in pumping of the desired fuel volume. As such, pulse calibration may include recursively reducing the pulse duration from the initial duration and observing the fuel volume pumped resulting from application of each pulse duration. The pulse duration may be reduced until a pulse duration is reached whose application does not result in pumping of the desired fuel volume. The pulse duration may be reduced by various suitable increments (e.g., 10 ms, 50 ms, 100 ms, various percentages such as 10%, 50%, etc.), which may be a function of fuel system 208. Once such an insufficient pulse duration is identified, the last and smallest pulse duration whose application resulted in pumping of the desired fuel volume may be selected as the pulse duration to be employed in intermittently operating lift pump 212 until subsequent performance of the calibration. In some examples, selection of the initial pulse duration may be informed by predetermined knowledge of the relationship between pulse duration and resulting fuel volume pumped—for example, selection may use information obtained from one or more previous pulse calibrations and/or information stored in a suitable data structure (e.g., lookup table) relating pumped fuel volumes to pulse durations as a function of fuel temperature.

Various suitable fuel volumes may be selected as the desired fuel volume. For example, the desired fuel volume may be a maximum fuel volume that can be consumed by engine 202 (e.g., during peak load). By selecting the maximum fuel volume as the desired fuel volume, pulse calibration ensures that application of an optimized pulse duration results in supply of the maximum fuel volume when required by engine 202.

It will be appreciated that driving lift pump 212 with pulses may include supplying various suitable voltages to the lift pump (e.g., lift pump motor). In some examples, application of each pulse to lift pump 212 may include driving the lift pump at a single voltage (e.g., 10 V). The single voltage may be a maximum voltage that can be supplied to lift pump 212, for example.

Having determined the minimum pulse duration whose application results in pumping of the desired fuel volume, pulse calibration may then determine an optimized inter-pulse duration—that is, the duration that separates each successive pair of pulses. Determining the inter-pulse duration may include driving lift pump 212 for the minimum pulse duration each time the pressure at the inlet of higher pressure fuel pump 214 falls to the fuel vapor pressure. This may be performed on an iterative basis for a suitable number of times, with the resulting fuel volume pumped between each pulse (e.g., at each iteration) being examined. In some scenarios, a distribution of pumped fuel volumes about the desired fuel volume may be observed; as a non-limiting example, for seven pulses the respective pumped fuel volumes may be 4.1, 4.2, 4.1, 3.9, 3.8, 4.0, and 4.0 cc. A selected fuel volume (e.g., 3.8 cc) less than the desired fuel volume may be selected as a parameter to which pulsing of lift pump 212 is responsive. That is, lift pump 212 may be pulsed each time it is determined that the selected fuel volume has been pumped, which may be in contrast to other approaches in which a lift pump is intermittently pulsed responsive to the volumetric efficiency and/or inlet pressure of a higher pressure fuel pump downstream of the lift pump. Pulsing lift pump 212 responsive to the selected fuel volume may be implemented in an open loop control scheme, for example. Selection of a fuel volume less than the desired fuel volume may cause lift pump 212 to be pulsed before the inlet pressure of higher pressure fuel pump 214 reaches the fuel vapor pressure and operation of the higher pressure fuel pump degrades, as selection of a relatively higher fuel volume (e.g., 4.1 cc) may cause the higher pressure fuel pump inlet pressure to fall to the fuel vapor pressure with undesired frequency. In this way, the volumetric efficiency of higher pressure fuel pump 214 may be maintained at a desired level. On the other hand, the selected fuel volume may be also chosen to maximize the inter-pulse duration while allowing the inlet pressure of higher pressure fuel pump 214 to be maintained above the fuel vapor pressure. In this way, the frequency with which lift pump 212 is pulsed may be minimized, maximizing energy savings.

It will be appreciated that operation of fuel system 208 may vary as a function of fuel temperature. As such, pulse calibration may be performed for one or more ranges of fuel temperatures so that optimized pulse and inter-pulse durations may be learned for the one or more ranges. For example, optimized pulse and inter-pulse durations may be learned for a first range of fuel temperatures. A determination may be made that the fuel temperature has changed by a threshold amount, entering a second range of fuel temperatures different from the first range. This determination may prompt pulse calibration for the second range of fuel temperatures, as employing the pulse and inter-pulse durations optimized for the first range of temperatures in the second range of temperatures may result in undesired operation of fuel system 208—e.g., unnecessary energy consumption by lift pump 212, excessive fuel volumes pumped, unacceptable volumetric efficiency of higher pressure fuel pump 214, etc. Learned and/or stored (e.g., previously determined and programmed into a controller) pulse and inter-pulse durations may be associated with respective fuel temperatures and stored in an accessible data structure comprising a plurality of pulse and/or inter-pulse durations and associated fuel temperatures such as a lookup table, for example.

As described above, lift pump 212 may be selectively operated according to the intermittent operating mode or a continuous operating mode. In some implementations, the operating mode of lift pump 212 may be selected according to the instant speed and/or load of engine 202. A suitable data structure such as a lookup table may store the operating modes which may be accessed by using engine speed and/or load as indices into the data structure, which may be stored on and accessed by controller 222, for example. The intermittent operating mode in particular may be selected for relatively lower engine speeds and/or loads. During these conditions, fuel flow to engine 202 is relatively low and lift pump 212 has capacity to supply fuel at a rate that is higher than the engine's fuel consumption rate. Therefore, lift pump 212 can fill accumulator 215 and then be turned off while engine 202 continues to operate (e.g., combusting air-fuel mixtures) for a period before the lift pump is restarted. Restarting lift pump 212 replenishes fuel in accumulator 215 that was fed to engine 202 while the lift pump was off.

During relatively higher engine speeds and/or loads, lift pump 212 may be operated continuously. In one embodiment, lift pump 212 is operated continuously when the lift pump cannot exceed the engine fuel flow rate by an amount (e.g., 25%) when the pump is operated at an "on" duty cycle (e.g., 75%) for a period of time (e.g., 1.5 minutes). However, if desired, the "on" duty cycle level that triggers continuous lift pump operation may be adjusted to various suitable percentages (e.g., 35%, 40%, 45%, 50%, 55%, 60%, 65%, 70%, etc.).

In the continuous operating mode, lift pump 212 may be operated at a substantially constant voltage (e.g., 10 V+/−0.2 V), or the supply voltage may be modulated such that the pump speed can be controlled to deliver a desired pressure at the inlet of higher pressure fuel pump 214. If the supply voltage to lift pump 212 is modulated, the lift pump turns continuously without stopping between voltage pulses. Providing a narrowly spaced pulse train of voltage allows controller 222 to control pump flow so that lift pump flow essentially matches the amount of fuel being injected into engine 202. This operation can be accomplished by setting the lift pump duty cycle as a function of engine speed and load, for example. Alternatively, the average supply voltage to lift pump 212 from the modulated voltage can be varied as the amount of fuel supplied to engine 202 varies. In other embodiments, a controlled current output may be used to supply current to lift pump 212. The amount of current supplied to lift pump 212 can be varied with engine speed and load, for example.

Turning now to FIG. 3, a flowchart illustrating a method 300 of operating a lift pump is shown. Method 300 may be employed to operate lift pump 212 of fuel system 208, for example. In some examples, method 300 may include determining whether to operate the lift pump according to an intermittent operating mode or a continuous operating mode, and, further, determining whether to perform pulse calibration. Should the intermittent operating mode and pulse calibration be selected, the lift pump may be intermittently operated according to pulse and inter-pulse durations determined via the pulse calibration.

At 302 of method 300, it is determined whether various operating conditions are suitable for operating the lift pump according to the intermittent operating mode. In some examples, suitable operating conditions may include one or both of an engine speed and an engine load being below respective thresholds. For example, the intermittent operating mode may be selected if one or both of the engine speed and load are relatively low. Such conditions may be selected such that the intermittent operating mode does not unacceptably disrupt or degrade engine performance; stipulation of these conditions may enable provision of fuel to the engine at a rate faster than that at which the fuel is consumed by the engine, for example. If it is determined that the various operating conditions are not suitable for operating the lift pump intermittently (NO), method 302 proceeds to 312—e.g., if one or both of the engine speed and engine load are equal to or above the respective thresholds. If it is determined that the various operating conditions are suitable for operating the lift pump intermittently (YES), method 302 proceeds to 304.

At 304 of method 300, it is determined whether to perform pulse calibration. As described above, the intermittent operating mode may include driving the lift pump by supplying voltage pulses spaced apart from each other such that the pulses activate the lift pump, and the periods (e.g., inter-pulses) between the pulses do not activate (e.g., deactivate) the lift pump. The duration of the pulses and the inter-pulses may be optimized as part of the pulse calibration to minimize energy consumption by the lift pump while enabling desired performance of the overall fuel system—e.g., enabling a desired volumetric efficiency of a higher pressure fuel pump downstream of the lift pump, enabling desired fuel volumes to be supplied to the engine, etc. Operation of the lift pump and fuel system may vary as a function of the temperature of the fuel in the fuel system. As such, usage of the pulse and inter-pulse durations may result in different outcomes for different temperatures; durations optimized for one range of temperatures may not be optimal for a different range of temperatures. Accordingly, determining whether to perform pulse calibration may include determining whether a threshold change in fuel temperature has occurred, and if so, the calibration may be performed. Alternatively or additionally, determining whether to perform pulse calibration may include accessing a data structure (e.g., lookup table) storing pulse and inter-pulse durations as a function of fuel temperature to assess whether suitable durations are available for the instant fuel temperature; if not, pulse calibration may be performed. Alternatively or additionally, determining whether to perform pulse calibration may include determining whether the engine is operating under idle conditions; if so, pulse calibration may not be performed so as to prevent NVH from arising from the calibration that may be especially prominent and perceptible by a vehicle operator during idle conditions.

If it is not determined to perform pulse calibration (NO), method 300 proceeds to 308 where the lift pump is operated based on stored pulse and inter-pulse durations. The stored durations may have resulted from previous pulse calibration and/or may be predetermined and programmed into an engine controller, for example. Pulses may be issued to the lift pump responsive to various conditions (which may be a function of a previous pulse), including but not limited to the outlet pressure of the lift pump falling to a threshold outlet pressure (e.g., slightly above fuel vapor pressure), a desired fuel volume being pumped, expiration of the inter-pulse duration, etc. Following 308, method 300 returns to 302 so that the suitability of the various operating conditions for the intermittent operating mode may be persistently evaluated throughout engine operation, enabling the continuous operating mode to be selected when appropriate. If it is determined to perform pulse calibration (YES), method 300 proceeds to 306 where pulse calibration is performed.

Turning now to FIG. 4A, a flowchart illustrating a method 400 of performing pulse calibration is shown. Method 400 may be performed to optimizing pulse and inter-pulse durations used to intermittently operate lift pump 212 of FIG. 2, for example. In some examples, pulse duration determination may be responsive to the fuel pressure at the inlet of a higher pressure fuel pump (e.g., pump 214 of FIG. 2) downstream of the lift pump.

At 402 of method 400, power supply to the lift pump (e.g., lift pump motor) is ceased if power is being supplied to the lift pump. For example, the lift pump may have been operating according to the continuous operating mode prior to initiation of pulse calibration; as such power supply to the lift pump may be ceased, causing exit from the continuous operating mode. However, in other examples the lift pump may have been operating according to the intermittent operating mode as pulse calibration is initiated, and as such 402 may be skipped.

At 404 of method 400, the duration for which pulses are to be supplied to the lift pump in the intermittent operating mode is determined. Pulse duration determination includes, at 406, determining whether the inlet pressure of the higher pressure (HP) fuel pump is at the fuel vapor pressure. The fuel pressure at the inlet of the HP fuel pump may be determined via a fuel pressure sensor positioned between the lift and HP fuel pumps (e.g., LP fuel pressure sensor 231 of FIG. 2). The fuel vapor pressure may be determined based on the fuel temperature, for example. If it is determined that the inlet pressure of the HP fuel pump is not at the fuel vapor pressure (NO), method 400 returns to 406 such that further action is not performed until the inlet pressure of the HP fuel pump is at the fuel vapor pressure. If it is determined that the inlet pressure of the HP fuel pump is at the fuel vapor pressure (YES), method 400 proceeds to 408.

At 408 of method 400, the lift pump is pulsed for a duration. Upon the initial execution of 408, an initial duration may be selected. Selection of the initial duration is an initial attempt at identifying a minimum pulse duration whose application to the lift pump results in pumping of a desired fuel volume, which in some examples may be a maximum fuel volume consumed by the engine under peak load. In some examples, selection of the initial pulse duration may be informed by predetermined knowledge of the relationship between pulse duration and resulting fuel volume pumped—for example, selection may use information obtained from one or more previous pulse calibrations and/or information stored in a suitable data structure (e.g., lookup table) relating pumped fuel volumes to pulse durations as a function of fuel temperature.

At 410 of method 400, it is determined whether the desired fuel volume was pumped as a result of pulsing the lift pump for the duration. If it is determined that the desired fuel volume was pumped (YES), method 400 proceeds to 412 where the duration is reduced. Here, the pulse duration is reduced to identify the minimum pulse duration whose application results in pumping of the desired fuel volume. The pulse duration may be reduced until a pulse duration is identified whose application does not result in pumping of the desired fuel volume (e.g., a relatively smaller fuel volume). The pulse duration may be reduced by various suitable increments (e.g., 10 ms, 50 ms, 100 ms, various percentages such as 10%, 50%, etc.), which may be a function of fuel system 208. In some examples, every pulse duration may be reduced by the same amount, while in other examples, different reductions may be performed between different pulse pairs. Following 412, method 400 returns to 406 to enable recursive reduction of the pulse duration. If it is determined that the desired fuel volume was not pumped (NO), method 400 proceeds to 414 where the minimum pulse duration that caused the desired fuel volume to be pumped is selected. In some examples, the minimum pulse duration may be the next-to-last duration that was tested. It will be appreciated, however, that identification of the minimum pulse duration may include both reducing and increasing pulse durations; in this example, the minimum pulse duration may not be the next-to-last duration that was tested.

Turning now to FIG. 4B, at 416 of method 400, the inter-pulse duration is determined. Determining the inter-pulse duration includes, at 418, determining whether the inlet pressure of the HP fuel pump is at the fuel vapor pressure. If it is determined that the inlet pressure of the HP fuel pump is not at the fuel vapor pressure (NO), method 400 returns to 418. If it is determined that the inlet pressure of the HP fuel pump is at the fuel vapor pressure (YES), method 400 proceeds to 420.

At 420 of method 400, the lift pump is driven with a pulse for the minimum pulse duration selected at 414.

At 422 of method 400, the resulting fuel volume pumped due to driving the lift pump with the pulse for the minimum pulse duration is recorded.

At 424 of method 400, it is determined whether the lift pump has been driven a desired number of times (e.g., whether the lift pump has been driven with a desired number of pulses). The desired number of times or pulses may assume various suitable values and may be selected to obtain a desired sample size of pulses and resulting fuel volumes pump to select an optimal inter-pulse duration. If it is determined that the lift pump has not been driven the desired number of times (NO), method 400 returns to 418. If it is determined that the lift pump has been driven the desired number of times (YES), method 400 proceeds to 426.

At 426 of method 400, the inter-pulse duration corresponding to a fuel volume recorded at 422 that was pumped that is less than the desired fuel volume is selected. Selection of a fuel volume less than the desired fuel volume may cause the lift pump to be pulsed before the inlet pressure of the HP fuel pump reaches the fuel vapor pressure and operation of the higher pressure fuel pump degrades, as selection of a relatively higher fuel volume may cause the HP fuel pump inlet pressure to fall to the fuel vapor pressure with undesired frequency. In this way, the volumetric efficiency of the HP fuel pump may be maintained at a desired level. On the other hand, the selected fuel volume may be also chosen to maximize the inter-pulse duration while allowing the inlet pressure of the HP fuel pump to be maintained above the fuel vapor pressure. In this way, the frequency with which the lift pump is pulsed may be minimized, maximizing energy savings. As described in further detail below with reference to FIG. 5, the lift pump may be driven with pulses according to the inter-pulse duration (e.g., expiration thereof) and/or its corresponding inter-pulse fuel volume (e.g., full pumping thereof).

At 428 of method 400, the calibrated pulse (e.g., minimum pulse duration) and inter-pulse (e.g., selected inter-pulse duration) durations are stored as a function of the fuel temperature. In this way, pulse and inter-pulse duration retrieval, as well as pulse calibration, may be enabled.

Returning to FIG. 3, following 306, method 300 proceeds to 310 where the lift pump is operated based on the calibrated pulse and inter-pulse durations. Operating the lift pump based on the calibrated pulse and inter-pulse durations may include applying a pulse for the calibrated pulse duration to the lift pump each time the inter-pulse duration passes. It will be appreciated that application of pulses to the lift pump may be controlled on a temporal basis according to the calibrated inter-pulse duration. In other embodiments, application of pulses to the lift pump may be controlled on a pumped fuel volume basis; the lift pump may be pulsed upon detection that the fuel volume corresponding to the calibrated inter-pulse duration has been pumped. Pulse issuance may alternatively or additionally be responsive to other conditions, including but not limited to the outlet pressure of the lift pump falling to a threshold outlet pressure. Following 310, method 300 returns to 302.

If, at 302, it was determined that the various operating conditions are not suitable for operating the lift pump according to the intermittent operating mode (NO), method 300 proceeds to 312 where the lift pump is operated according to the continuous operating mode. In some examples, the continuous operating mode may employ a duty cycle which may not be 100%.

FIG. 5 shows a graph 500 illustrating pulse calibration for a lift fuel pump. Graph 500 may graphically illustrate calibration of pulse and inter-pulse durations as performed via method 400 for lift pump 212 of FIG. 2, for example.

Graph 500 includes a plot 502 of the voltage (in volts) supplied to the lift pump as a function of time, and a plot 504 of the fuel pressure (in Bar) at the outlet of the lift pump as a function of fuel volume injected (e.g., to an engine). In some examples, the outlet pressure of the lift pump may correspond to the inlet pressure of a HP fuel pump downstream of the lift pump.

From the beginning of the plots, to a time 506, the duration of the pulse is specifically calibrated (e.g., the on-duration of the pulse for which it is active). In this time period, an initial pulse duration (300 ms) is selected, and a pulse is supplied to the lift pump for the initial pulse duration. A fuel volume of 4 cc results from application of the initial pulse and is correlated with the initial pulse; in this example the fuel volume is the fuel volume that is desired to be pumped as a result of application of an optimized pulse duration. The initial pulse duration is then iteratively reduced, yielding three additional test pulses having respective durations of 200 ms, 100 ms, and 50 ms. Application of the 200 and 100 ms pulses yield the desired fuel volume, whereas application of the 50 ms pulse yields 2 cc, which is less than the desired fuel volume. As such, 100 ms is identified as the minimum pulse duration 508 whose application results in the desired fuel volume. In this example, pulses may be supplied to the lift pump responsive to the outlet pressure of the lift pump (or the inlet pressure of a higher pressure fuel pump downstream of the lift pump) falling to the fuel vapor pressure 509 during pulse calibration.

The objective sought when applying a voltage pulse is to bring the lift pump outlet pressure up to the pressure relief point (e.g., the pressure at which a relief valve such as valve 219 of FIG. 2 is configured to open and limit the lift pump outlet pressure to the pressure relief point) and then to stop applying the voltage pulse. In some examples, immediate cessation of the pulse is desired after the lift pump outlet pressure reaches the pressure relief point such that the outlet pressure spends as little time as possible at the pressure relief point. Notice that when the pulse duration was 300 ms and 200 ms, the lift pump outlet pressure profile included a flat top, indicating that the pulse was longer than necessary. However, when the pulse duration was 50 ms, the peak outlet pressure did not rise to the pressure relief point. Thus, this pulse duration was shorter than optimal. In this case, 100 ms is the optimal pulse duration. The pulse duration may thus be varied in this way to find the optimal duration.

From time 506 to the end of the plots, the inter-pulse duration is calibrated. As a corresponding fuel volume may be pumped during the inter-pulse duration, calibrating the inter-pulse duration may refer to calibrating the fuel volume pumped between successive pulses. During this time, the minimum pulse duration is employed four times and the resulting pumped fuel volumes are recorded. A distribution around the desired fuel volume can be observed. In the depicted example, 5 cc of fuel is pumped following application of the first pulse in the inter-pulse duration calibration region (e.g., after time 506). This fuel volume may be determined to be excessive based on the rate at which fuel pressure drops as a function of fuel volume following cessation of the pulse that caused pumping of the fuel volume. A desired rate of fuel pressure decrease may be determined for the fuel system (e.g., fuel system 208 of FIG. 2) comprising the intermittently-driven lift pump and compared to the rate of fuel pressure decrease occurring throughout pumping of the fuel volume (e.g., throughout the inter-pulse duration) to determine the suitability of the fuel volume (and/or the inter-pulse duration). In the depicted example, the desired rate of fuel pressure decrease is 1 bar/cc, represented by a line 510. However, toward the end of pumping of the 5 cc fuel volume, the actual rate of fuel pressure decrease falls below the desired rate of fuel pressure decrease (e.g., becoming approximately 0.88 bar/cc), the decreased rate of fuel pressure decrease represented by a line 512. As such, 5 cc is determined to be an unsuitable (e.g., excessive) inter-pulse fuel volume.

3 cc is the inter-pulse fuel volume pumped as a result of the next pulse. As can be seen in FIG. 5, however, the fuel pressure did not reach the fuel vapor pressure 509 before initiation of the subsequent pulse (e.g., it fell to approximately 5 bar). In this example, selection of the inter-pulse fuel volume may be a function of whether a lower threshold fuel pressure was reached upon fully pumping the fuel volume, alternatively or in addition to the rate of fuel pressure decrease. The lower threshold may be the fuel vapor pressure 509 or a pressure slightly thereabove, for example.

3.8 cc is the inter-pulse fuel volume pumped as a result of the next pulse. Selection of this inter-pulse fuel volume results in both a rate of fuel pressure decrease equal to the desired rate of fuel pressure decrease and reaching the fuel vapor pressure 509 upon fully pumping the fuel volume. As such, 3.8 cc may be chosen as the inter-pulse fuel volume, along with its corresponding inter-pulse duration 514.

3.9 cc is the inter-pulse fuel volume pumped as a result of the next and final pulse applied during the inter-pulse fuel volume calibration. This fuel volume results achieves both the desired rate of fuel pressure decrease and reaching the fuel vapor pressure 509 upon fully pumping the fuel volume. In some examples, maximization of the inter-pulse fuel volume may be desired as long as the rate of fuel pressure decrease and reaching of the lower threshold fuel pressure conditions are satisfied. In this case, 3.9 cc, and not 3.8 cc, may be selected as the inter-pulse fuel volume, along with its corresponding inter-pulse duration.

As described above, selecting the conditions in which a pulse is applied to the lift pump, and thus selection of the inter-pulse fuel volume, may be responsive to the volumetric efficiency of an HP fuel pump downstream of the lift pump—e.g., a pulse may be applied when it is determined that this volumetric efficiency has fallen to a lower threshold. An unacceptably low volumetric efficiency of the HP fuel pump may be avoided by choosing to apply pulses to the lift pump upon determining that the life pump outlet pressure falls to a lower threshold fuel pressure above the fuel vapor pressure 509, as the unacceptably low volumetric efficiency of the HP fuel pump may occur when the fuel vapor pressure is reached.

In some examples, the inter-pulse fuel volume may be less than a desired fuel volume that is desired to be pumped to an engine during the inter-pulse duration. For example, the desired fuel volume may be a fuel volume required to operate the engine under select conditions (e.g., maximum load). As a non-limiting example, the desired fuel volume may be 4 cc. Thus, in some examples, an inter-pulse duration may be adjusted based on a minimum value of pumped fuel. Driving the lift pump according to expiration of inter-pulse duration 514 and/or pumping of its corresponding inter-pulse fuel volume may enable the volumetric efficiency of the HP fuel pump to be maintained at a desired level. As described above, pulses may be applied to the lift pump responsive to one or more fueling conditions—for example, responsive to the outlet pressure of the lift pump falling to a threshold pressure (e.g., a pressure slightly above the fuel vapor pressure). The pulses may be repeatedly and continually applied to the lift pump as long as the one or more conditions are satisfied.

It will be appreciated that the fuel vapor pressure may vary as a function of various engine operating conditions, such as fuel temperature. As such, the inter-pulse fuel volume and/or inter-pulse duration may be calibrated responsive to changes in fuel temperature to maintain an optimal inter-pulse fuel volume and/or duration for the instant fuel temperature.

FIG. 5 illustrates how pulse and inter-pulse durations may be adjusted responsive to other parameters. As shown, iterative reduction of the pulse on-durations causes the duration in which the outlet pressure of the lift pump remains at a peak outlet pressure of the lift pump (which in this example is 8 Bar). As such, in some examples, a desired on-duration may be selected by identifying the on-duration for which the outlet pressure of the lift pump remains at the peak outlet pressure for less than a threshold duration—for example, duration 508 may be selected as it caused the outlet pressure outputted by the lift pump to remain at the peak outlet pressure for less than the threshold duration. Alternatively or additionally, a desired on-duration may be selected by iteratively reducing the on-duration of pulses until the fuel volume pumped by the lift pump, resulting from application of a pulse, is reduced. In the depicted example, duration 508 may be selected as the following duration (e.g., 50 ms) resulted in pumping of a reduced fuel volume (e.g., 2 cc) relative to the previous fuel volumes (e.g., 4 cc).

Various criteria described above may be used to select inter-pulse fuel volumes and/or durations. For example, the inter-pulse fuel volume may be maximized as long as the corresponding rate of fuel pressure decrease is not less than a desired rate of fuel pressure decrease and/or a lower threshold fuel pressure is reached upon fully pumping the fuel volume.

It will be appreciated that graph 500 is provided as an example and is not intended to be limiting in any way. The magnitudes, durations, and functional forms exhibited in graph 500 are provided as illustrative examples. In particular, it will be understood that the fuel volumes pumped prior to time 506 may vary about the values shown.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating a fuel pump, comprising:

during intermittent fuel pump operation including a plurality of voltage pulses being applied to the fuel pump where a speed of the fuel pump falls to zero between voltage pulses:

iteratively reducing an on-duration of each voltage pulse, until a peak outlet pressure of the fuel pump decreases from a peak outlet pressure corresponding to a previous voltage pulse, to identify a minimum pulse duration; and applying a voltage pulse having the minimum pulse duration to the fuel pump; and during continuous fuel pump operation including a plurality of voltage pulses being applied to the fuel pump where the fuel pump turns continuously without stopping between voltage pulses:

applying a varying duty cycle to the fuel pump.

2. The method of claim 1, wherein applying the voltage pulse having the minimum pulse duration to the fuel pump causes the fuel pump to pump a desired fuel volume, and wherein the fuel pump supplies fuel to an accumulator downstream of the fuel pump.

3. The method of claim 1, wherein the on-duration of each voltage pulse is iteratively reduced until a duration for which the fuel pump outputs the peak outlet pressure falls below a threshold.

4. The method of claim 1, wherein applying the voltage pulse having the minimum pulse duration to the fuel pump comprises applying voltage pulses having the minimum pulse duration to the fuel pump while one or both of an engine load and an engine speed are below respective thresholds, and wherein intermittent fuel pump operation comprises alternating pump-on periods and pump-off periods, the on-duration being a duration of the pump-on periods.

5. The method of claim 4, wherein the continuous fuel pump operation occurs while one or both of the engine load and the engine speed are equal to or above the respective thresholds, and wherein a speed of the fuel pump falls to zero during the pump-off periods.

6. The method of claim 1, wherein the voltage pulse having the minimum pulse duration is applied to the fuel pump responsive to an outlet pressure of the fuel pump falling to a lower threshold pressure, wherein the duty cycle is based on an engine speed and an engine load, and wherein a speed of the fuel pump falls to zero during pump-off periods.

7. The method of claim 1, wherein the voltage pulse having the minimum pulse duration is applied to the fuel pump responsive to a fuel volume being pumped by a high-pressure fuel pump disposed downstream of the fuel pump.

8. The method of claim 7, wherein the fuel pump is a lift pump, and wherein the fuel volume is less than a desired fuel volume, that when pumped by the lift pump, causes an inlet pressure of the high-pressure fuel pump to fall substantially to a fuel vapor pressure.

9. The method of claim 1, further comprising:

associating the minimum pulse duration with a fuel temperature; and storing the minimum pulse duration associated with the fuel temperature in a data structure comprising a plurality of minimum pulse durations each associated with a respective fuel temperature.

10. The method of claim 1, wherein the on-duration is iteratively reduced responsive to a threshold change in fuel temperature.

11. A method of operating a fuel pump, comprising:

under first conditions, driving the fuel pump intermittently by applying a voltage pulse two or more times; and iteratively reducing a duration of each voltage pulse until a fuel volume pumped resulting from application of the reduced voltage pulse is reduced to identify a minimum duration; and under second conditions, driving the fuel pump intermittently with a voltage pulse lasting the minimum duration, wherein driving the fuel pump intermittently comprises repeatedly applying the voltage pulse to the fuel pump, where each voltage pulse is spaced apart from an adjacent voltage pulse by an inter-pulse duration in which the fuel pump is off and a speed of the fuel pump falls to zero.

12. The method of claim 11, further comprising:

under the first conditions, driving the fuel pump with the voltage pulse lasting the minimum duration two or more times;

correlating a fuel volume pumped with each application of the voltage pulse lasting the minimum duration; and identifying an inter-pulse fuel volume less than a desired fuel volume; and under the second conditions, driving the fuel pump with the voltage pulse lasting the minimum duration upon pumping of the inter-pulse fuel volume.

13. The method of claim 12, wherein driving the fuel pump with the voltage pulse lasting the minimum duration upon pumping of the inter-pulse fuel volume maintains an outlet pressure of the fuel pump above a fuel vapor pressure.

14. The method of claim 11, wherein, before the fuel volume is reduced, a fuel volume pumped resulting from application of the voltage pulse is a desired fuel volume at each reduced iteration.

15. The method of claim 11, wherein the first conditions include occurrence of a threshold change in fuel temperature, and further comprising, when an engine speed or an engine load is above a respective threshold, continuously operating the fuel pump by applying a duty cycle to the fuel pump, said duty cycle based on the engine speed and the engine load, and where continuously operating the fuel pump includes applying a plurality of voltage pulses to the fuel pump where the fuel pump turns continuously without stopping between voltage pulses.

16. The method of claim 11, wherein the second conditions include one or both of engine speed and engine load being below respective thresholds, and wherein the fuel pump is a lift pump delivering fuel to an accumulator disposed between the lift pump and a downstream high-pressure fuel pump.

17. A method of operating a fuel pump, comprising:

during a first condition:

iteratively reducing an on-duration of a fuel pump pulse, until an outlet pressure of the fuel pump remains at a peak outlet pressure for less than a threshold duration, to identify a desired pulse duration, wherein the fuel pump is pumping fuel during the pulse;

repeatedly applying the pulse for the desired pulse duration to the fuel pump responsive to a fueling condition, wherein each pulse is spaced apart from successive pulses by an inter-pulse duration; and adjusting the inter-pulse duration between successive pulses based on a minimum value of pumped fuel for the repeated application of the pulses for the desired pulse duration, wherein a speed of the fuel pump falls to zero during the inter-pulse duration; and during a second condition:

continuously applying a duty cycle to the fuel pump, the duty cycle based on an engine speed and an engine load.

18. The method of claim 17, wherein application of the pulse for the desired pulse duration results in pumping of a desired value of pumped fuel, wherein the minimum value of pumped fuel is less than the desired value of pumped fuel, and wherein the first condition includes the engine speed or the engine load being below respective thresholds, and wherein the second condition includes the engine speed or the engine load being above the respective thresholds.

19. The method of claim 18, further comprising storing the desired pulse duration and the desired value of pumped fuel as a function of fuel temperature, and wherein the fuel pump is a lift pump disposed upstream of a high-pressure fuel pump.

20. The method of claim 17, wherein the fueling condition includes pumping of a desired value of pumped fuel, and wherein the fuel pump delivers fuel to an accumulator disposed downstream of the fuel pump.

* * * * *